United States Patent [19]

LaVasseur

[11] 4,048,979

[45] Sept. 20, 1977

[54] FUEL-SAVING FIREPLACE SCREEN UNIT

[76] Inventor: Jon D. LaVasseur, 12305-24th Ave. N., Minneapolis, Minn. 55441

[21] Appl. No.: 662,730

[22] Filed: Mar. 1, 1976

[51] Int. Cl.[2] ..... F24C 15/36

[52] U.S. Cl. ..... 126/202; 126/140; 160/135

[58] Field of Search ..... 126/202, 138, 140, 120, 126/201; 160/135, DIG. 9, 351, 352, 229; 16/135

[56] References Cited

U.S. PATENT DOCUMENTS

| | | | |
|---|---|---|---|
| 972,636 | 10/1910 | Pafford | 126/202 |
| 1,098,218 | 5/1914 | Boileau | 160/352 X |
| 2,294,046 | 8/1942 | Cser | 126/202 |
| 2,527,403 | 10/1950 | Davis et al. | 16/135 |
| 3,457,907 | 7/1969 | Brunig | 126/140 |
| 3,469,276 | 9/1969 | Dickson | 16/135 |

FOREIGN PATENT DOCUMENTS

| | | | |
|---|---|---|---|
| 426,151 | 3/1935 | United Kingdom | 160/135 |
| 324,524 | 1/1930 | United Kingdom | 126/202 |

*Primary Examiner*—Kenneth W. Sprague
*Assistant Examiner*—Harold Joyce
*Attorney, Agent, or Firm*—Stuart R. Peterson

[57] ABSTRACT

The portable fireplace screen unit comprises a glass panel of sufficient size to close the typical fireplace opening. Screen panels are hingedly connected to the opposite side edges of the glass panel. When the screen panels are angled toward the fireplace and the glass panel spaced away from the fireplace opening, air needed to support combustion readily flows through the two perforate screen panels as well as over the top of the imperforate glass panel. When the screen panels are angled in an opposite direction and the glass panel placed against the fireplace, the opening is closed to prevent unnecessary heat loss. The screen panels can be folded against the glass panel for compact storage of the unit.

8 Claims, 11 Drawing Figures

Fig 1
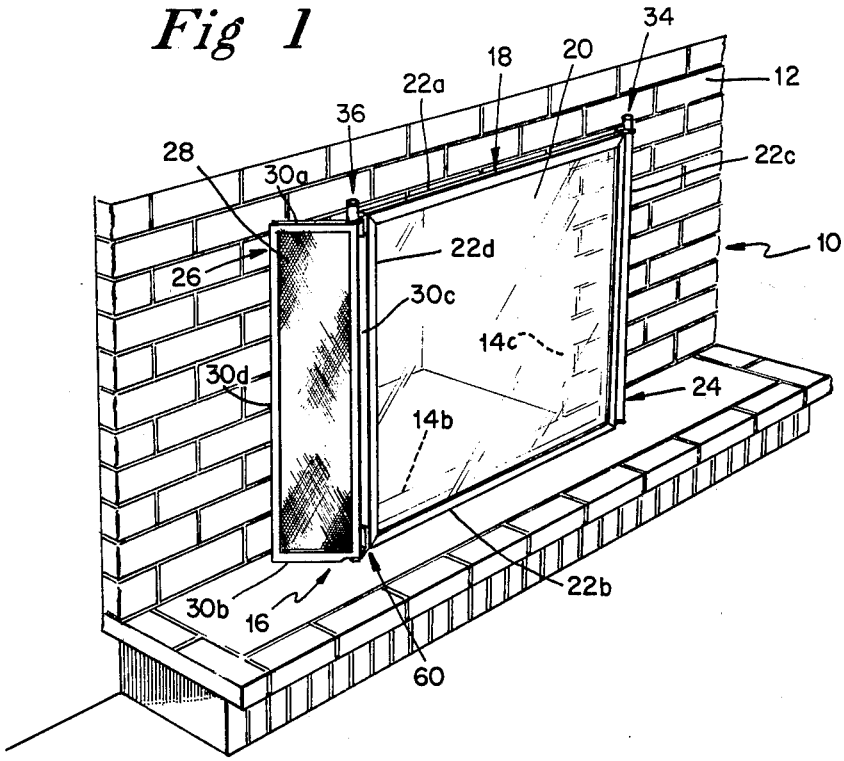
Fig 7
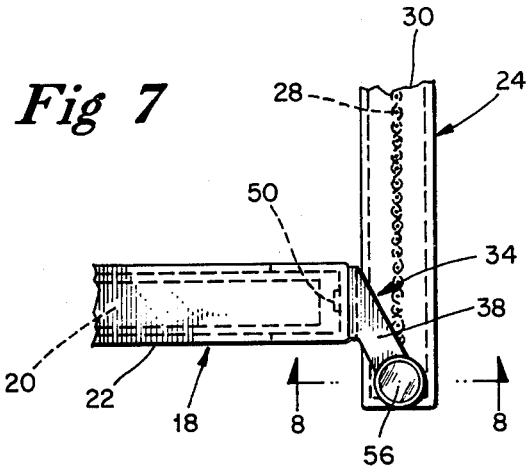
Fig 10
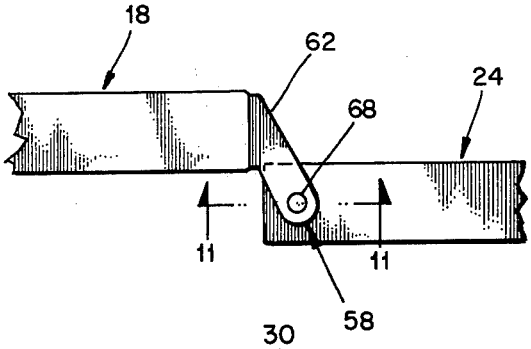
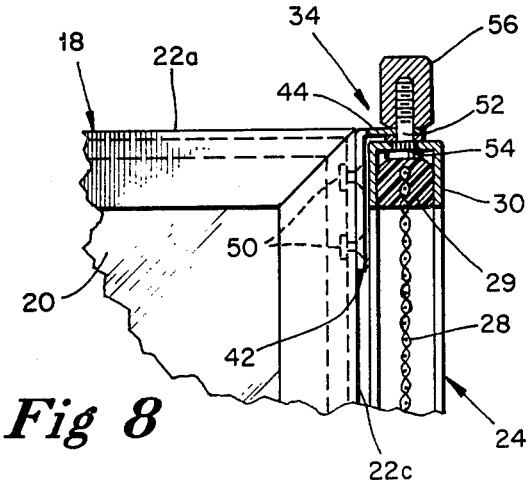
Fig 8
Fig 11
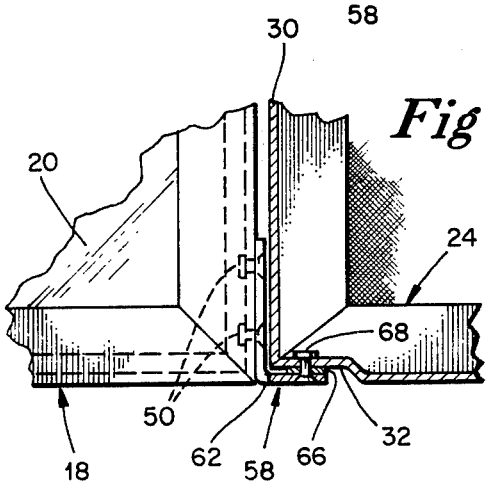

FUEL-SAVING FIREPLACE SCREEN UNIT

BACKGROUND OF THE INVENTION

1. Field of the Invention

This invention relates generally to fireplace screens, and pertains more particularly to a portable unit that in one position will permit normal air flow through the fireplace opening when a fire is burning and will prevent air flow when the fire is to die out or the fireplace is not in use.

2. Description of the Prior Art

Numerous fireplace screens have been contrived in the past for preventing sparks from escaping while permitting air to flow into the fireplace to sustain combustion. Some screens are portable, being merely placed in front of the fireplace opening, and others are permanently installed within the fireplace opening. Some utilize doors so that the air flow can be shut off when there is no fire or the fire is no longer wanted, thereby effecting a saving of fuel because a considerable amount of room heat is lost through the chimney as the fire is dying, and also after the fire is completely out as long as the chimney damper is not closed. The chimney damper cannot be closed until the fire is competely out because of the smoke that would result. However, permanently mounted fireplace screens can be quite costly because of their relatively high purchase price and/or the installation expense.

SUMMARY OF THE INVENTION

A general object of the present invention is to provide a fireplace screen unit that will serve a dual purpose in that in one position it will permit the free flow of air into the fireplace and in a second position will effectively block the flow of such air. In the first position combustion is readily supported; in the second position room heat loss is effectively thwarted.

Another object of the invention is to provide a fireplace screen unit that is portable, requiring no installation. Also, my invention has as an aim a fireplace screen unit that will be self-standing or self-supporting when placed to one side, such as when initially igniting the wood or later cleaning out the ashes, as well as when performing either of its intended functions.

A further object of my invention is to provide a fireplace screen unit of the foregoing character that can be inexpensively manufactured and sold, thereby encouraging its widespread use.

Still another object of the invention is to provide a fireplace screen unit that can be quickly and easily adjusted between its air permitting and air preventing positions.

Another object is to provide a fireplace screen unit that will not interfere with the adding of logs to an already burning fire, although it is contemplated that my screen unit can be easily moved completely away from the fireplace, if desired, in order to start the fire and to provide subsequent access for cleaning out the resulting ashes.

A further object is to provide a fireplace screen unit that is not restricted to any specific size of fireplace opening, my unit being suitable for use with most fireplaces currently in existence.

Yet another object is to provide a fire screen unit which will not obstruct the user's view of the fire. Also, my unit enables the user to check on when the fire has completely died out so that he can then close the chimney damper, if he wishes.

Another object of the invention is to provide a fireplace screen unit that can be completely collapsed or folded into a compact condition so as to facilitate its storage when not needed, such as between heating seasons.

Still further, an object is to provide a fireplace screen unit that will be aesthetically pleasing in addition to its functional capabilities.

Briefly, my invention contemplates the use of a central panel containing therein a glass pane, although two such panels could be either hingedly or fixedly connected to each other. A pair of wing panels are hingedly connected to the opposite side edges of the central panel, each wing panel containing therein a section of wire screen so that air can flow through these two panels when the free edges thereof are placed against a fireplace wall and the imperforate glass panel spaced away from the fireplace opening. When the wing panels are swung outwardly in a reverse direction away from the fireplace and the glass panel against the fireplace to close its opening, then the flow of air into the fireplace is discontinued with a concomitant prevention of heat loss from the inside of the dwelling through the fireplace and chimney to the outside. My invention envisages a particular type of hinge construction so that the wing or screen panels can be pivoted into a confronting relationship with the central glass panel (or panels) so that the unit can be readily stored when not needed.

BRIEF DESCRIPTION OF THE DRAWINGS

FIG. 1 is a perspective view of my fireplace screen unit when permitting air to flow into the fireplace;

FIG. 7 is an enlarged detail view taken generally in the direction of line 7—7 of FIG. 2 for the purpose of depicting one of the upper hinge mechanisms, the wing panel being shown perpendicular to the fireplace to facilitate drafting;

FIG. 8 is a sectional view taken in the direction of line 8—8 of FIG. 7;

FIG. 10 is a bottom plan view taken in the direction of line 10—10 of FIG. 2 for the purpose of illustrating one of the bottom hinge mechanisms, the wing panel having been swung from the perpendicular position of FIG. 7 through 90° into a parallel relation with the fireplace to facilitate drafting, and FIG. 11 is a sectional view taken in the direction of line 11—11 of FIG. 10.

DESCRIPTION OF THE PREFERRED EMBODIMENT

Figure 2:
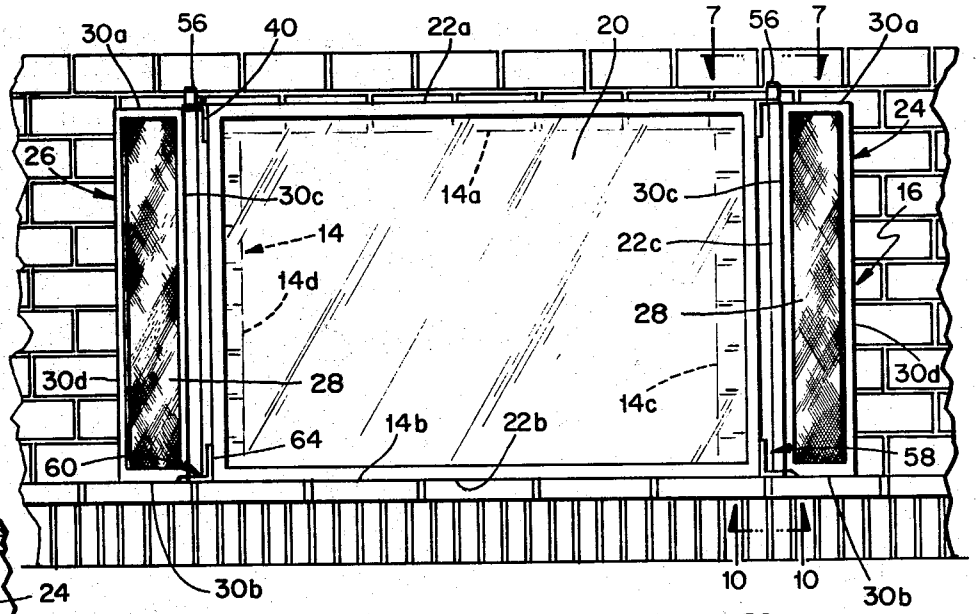
FIG. 2 is a front elevational view corresponding to FIG. 1.

A typical fireplace has been denoted generally by the reference numeral 10 which includes a fireplace wall 12 and a fireplace opening 14. For the sake of facile reference, the top of the fireplace opening 14 has been labeled 14*a*, the bottom or hearth 14*b* and the sides 14*c* and 14*d*. It will be appreciated that the chimney extending upwardly from the interior of the fireplace has the usual damper mounted therein so that the upward flow of air through the chimney can be shut off when the fireplace is not in use.

My fireplace screen unit has been generally designated by the reference numeral 16. In the illustrative embodiment, the fireplace screen unit 16 includes a central imperforate panel 18 having a single transparent glass pane 20 contained therein. The panel 18 further includes conventional channel-shaped metal molding 22 having a top edge 22*a*, a bottom edge 22*b* and side edges 22*c* and 22*d*. If desired, the single panel 18 can be in the form of two smaller panels, each one containing a glass panel of, say, one-half the width of the pane 20; the two smaller panels would be either rigidly or hingedly connected together at their adjacent edges.

The fireplace screen unit 16 exemplifying my invention further includes a pair of perforate wing panels 24, 26, each containing a sheet or section of wire 28. As with the imperforate panel 18, the screen 28 is marginally embraced by plastic caulking 29 (FIG. 8) contained in channel-shaped metal molding 30. In each instance the molding 30 has a top edge 30*a*, a bottom edge 30*b* and side edges 30*c* and 30*d*. For a purpose presently to be explained, each bottom edge 30*b* is inset or recessed upwardly at 32 (FIG. 11).

At this time, attention is directed to two top hinge mechanisms 34 and 36. The hinge mechanism 34 includes an angle member 38 and the hinge mechanism 36 a similar angle member 40. The angle member 38 (FIG. 9) has a vertical leg 42 and a horizontal leg 44. The vertical leg 42 has a pair of holes 46 therein and the horizontal leg 44 a single hole 48 therein. The angle member 38, more specifically its vertical leg 42, is permanently secured or attached to the upper portion of the side edge 22*c* of the metal molding 22 for the imperforate panel 18, as can be appreciated from FIGS. 7 and 8, by a pair of pop rivets 50. The hinge mechanism 34 further includes an upwardly directed threaded stud 52, the head 54 of the stud 52 being contained within the metal molding 30, more specifically beneath the top edge 30*a* of the panel 24. The stud 52 extends through the hole 48 in the horizontal leg 44 of the angle member 38. A knob 56 functions as a retaining nut, having a tapped hole for receiving the upper end of the threaded stud 52.

Figure 6:
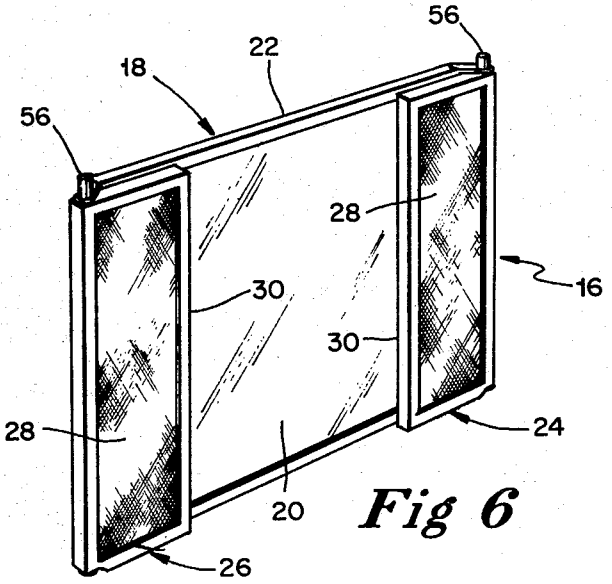
FIG. 6 is a perspective view of the folded fireplace screen unit as shown in FIG. 5.
Figure 5:
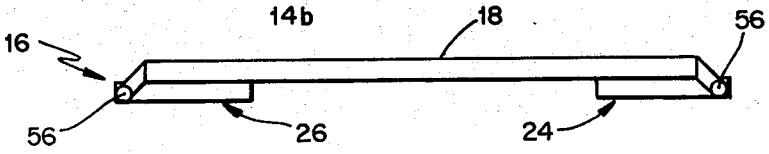
FIG. 5 is a top plan view also corresponding to FIG. 3 but with my fireplace unit folded for storage.
Figure 9:
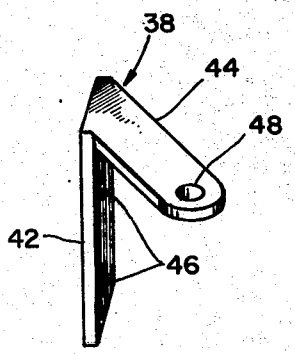
FIG. 9 is a perspective view of one of the hinge elements.

From FIGS. 7 and 9, it will be discerned that the horizontal leg 44 of the angle member 38 extends at a forwardly directed acute angle with respect to the vertical leg 42. Stated somewhat differently, the horizontal leg 44 angles forwardly or away from the fireplace wall 12 when the unit is being used as pictured in FIG. 3. This enables the imperforate panel 18 to be placed against the wall 12 without interference, thereby minimizing air leakage between the molding 22 and the fireplace 10. Also, the angulation permits the folding of the wing or perforate panel 24 against the glass or imperforate panel 18 as shown in FIGS. 5 and 6, this being the collapsed condition achievable when the unit 16 is to be stored such as in between heating seasons. The hinge mechanism 36 is of virtually the same construction as the hinge mechanism 34, the angulation of the horizontal leg with the vertical leg of the angle member 40 being opposite to the angulation of the horizontal leg with the vertical leg of the angle member 38, since the member 40 is attached to the side 22*d* of the molding 22.

Describing now one of the bottom hinge mechanisms labeled 58, 60, it will be seen that the hinge mechanism 58 includes an angle member 62 that is identical to the angle member 40 (but inverted); the hinge mechanism 60 includes an angle member 64 that is identical to the member 38 (but inverted). The vertical leg of the member 62 is attached to the lower end portion of the side edge 22*c* of the metal molding 22. The recess 32 has already been mentioned.

Even though relatively thin sheet metal stock is intended for the angle members 62, 64 (and also the members 38, 40), of the bottom hinge mechanisms 58, 60, it is preferable that the bottom edges 30*b* of the metal molding 30 for both wing panels 24, 26 be recessed as described in order to accommodate the thickness of the horizontal leg of the angle members 62, 64 in each instance. It will also be appreciated that the recessing just alluded to can be sufficient to accomodate a thin washer 66 on the rivet 68 employed in each bottom hinge mechanism 58, 60. Stated somewhat differently, it will be understood that the bottom side of each horizontal leg of the lower angle members 62, 64 should be substantially flush with the lower surfaces of the bottom edges 30*b* of the metal molding 30 for the two panels 24. In other words, the bottom edges 22*b* and 30*b* of all three panels 18, 24 and 26 should rest firmly on the fireplace hearth.

From the foregoing information, the manner of using my fireplace screen unit 16 should be readily comprehended. However, a brief description of the manner in which it is used will assure a full appreciation of the benefits to be derived from a practicing of my invention.

Figure 3:
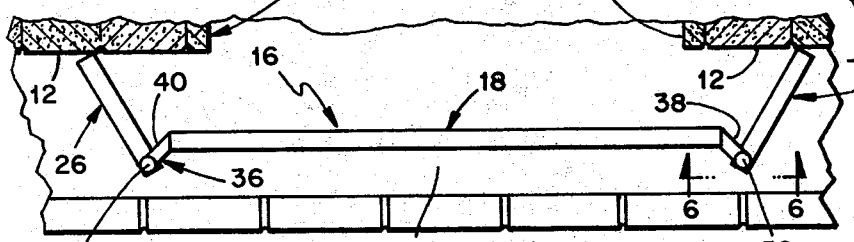
FIG. 3 is a top plan view of FIG. 2.

Assuming that the fireplace screen unit 16 is to be used in front of the fireplace 10 with a fire burning therein, then the central panel 18 is placed in a forwardly displaced relation from the fireplace wall 12 and the wing panels 24, 26 angled toward the fireplace 10, the edges 30*d*, 30*d* actually abutting the fireplace wall 12 as can be noted in FIG. 3. This permits air to flow through the screens 28 of the two wing panels 24, 26 as well as over the top of the central panel 18. When used in this fashion, my unit 16 offers virtually no obstruction to a natural draft or free flow of air into the fireplace 10 through its opening 14, yet prevents sparks or glowing embers from being discharged into the room.

Figure 4:
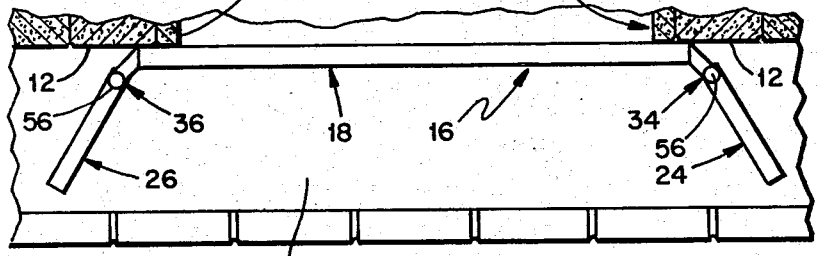
FIG. 4 is a top plan view corresponding to FIG. 3 but with the screen unit blocking the flow of air into the fireplace.

When the fire in the fireplace 10 is to be permitted to die out, the user should, of course, refrain from adding any more wood for as long in advance as possible. At the appropriate time, all that the user need do is to swing the perforate wing panels 24, 26 into a forwardly disposed angle, as illustrated in FIG. 4. The central panel 18, being imperforate, is then moved against the fireplace wall 12 so that the opening 14 is closed, thus preventing the escape of any significant amount of warm room air with an attendant saving of furnace fuel. If the user is retiring, the amount of energy saved during the remainder of the night can be quite substantial.

Even though fireplace openings 14 may vary somewhat in size, there is a practical range of dimensions usually encountered. All that need be taken into account is that the top edge 22*a* of the metal molding 22 be somewhat higher than the top edge 14*a* of the customary opening 14. Similarly, the side edges 22*c* and 22*d* should be spaced from each other a somewhat greater distance than the maximum spacing of the side edges 14*c* and 14*d* of the typical opening 14.

The width of the imperforate wing panels 24, 26 can vary. Normally, the width of these wing panels 24, 26, that is the distance between their side edges 30*c* and 30*d*, will be less than half the width of the panel 18, that is less than half the distance between side edges 22*c* and 22*d*. This allows the fireplace unit 16 to be folded or collapsed into the condition depicted in FIGS. 5 and 6 without any overlapping of the panels 24, 26. Consequently, a thin and compact condition can be achieved as far as my unit 16 is concerned, thereby facilitating its storage whenever the unit is not needed, as between heating seasons.

It is important to understand that my fireplace screen unit 16 is self-supporting. In this regard, it does not require any fastening or attachment to the fireplace 10. Although wood can be added to a fire in the fireplace 10 without removing the unit 16 from the position shown in FIGS. 1, 2 and 3, doing so through the space between the top edge 22*a* of the panel 18 and the top 14*a* of the fireplace opening 14, the edges 30*a* on panels 24 and 26 can readily be grasped and the entire unit 16 moved away from the opening 14 in order to permit complete access to the opening 14, such as when starting a fire or removing ashes after the fire has been extinguished. The edges 30*a* also facilitate the shifting of the central imperforate panel 18 against the fireplace wall 12 when the opening 14 is to be closed, as when going from the relationship shown in FIG. 3 to FIG. 4 and vice versa.

I claim:

1. A portable fireplace screen unit comprising imperforate central panel means including a transparent glass pane, said panel means having a top, a bottom and opposite sides, the top being spaced sufficiently above the bottom and the sides spaced sufficiently apart so that said imperforate panel means will close the opening of a conventional fireplace when placed in a confronting position thereagainst, said bottom constituting an uninterrupted straight edge for contacting the hearth of a fireplace, first and second perforate wing panel means, each having a top, a bottom and opposite sides, first hinge means pivotally connecting one side of said perforate panel means to one side of said imperforate panel means so that said first perforate panel means can be freely pivoted into angular relationships to either side of a planar relationship with said imperforate central panel means, and second hinge means pivotally connecting one side of said second perforate means to the other side of said imperforate panel means so that said second perforate panel means can be freely pivoted into angular relationships to either side of a planar relationship with said imperforate central panel means, the bottoms of said first and second wing panel means also constituting uninterrupted straight edges for contacting the hearth of a fireplace and being at the same general elevation as the edge of the bottom of said central panel means, whereby with the bottom edge of said central panel means resting on said hearth both of said perforate panel means can be swung into angles extending toward the fireplace so as to maintain said imperforate panel means away from the fireplace to permit a substantial flow of air through the fireplace opening and swung into angles extending away from the fireplace so as to maintain said imperforate panel means in its said confronting position with the fireplace to prevent substantial flow of air through said opening.

2. A fireplace screen unit in accordance with claim 1 in which said first and second perforate wing panel means each includes a sheet of screen material.

3. A fireplace screen unit in accordance with claim 2 in which said first and second hinge means angle away from the fireplace.

4. A fireplace screen unit in accordance with claim 3 including channel-shaped molding extending about the top, bottom and sides of said glass pane, and respective channel-shaped molding extending about the top, bottom and sides of each sheet of screen material, said first hinge means being attached to one of the moldings for said glass pane and the molding for one sheet of screen material, and said second hinge means being attached to the opposite side of the molding for said glass pane and the molding for the other sheet of screen material.

5. A fireplace screen unit in accordance with claim 4 in which said first hinge means includes upper and lower hinge mechanisms and said second hinge means includes upper and lower hinge mechanisms.

6. A fireplace screen unit in accordance with claim 5 in which each of said upper hinge mechanisms includes an angled member having a vertical leg attached to the molding for said glass pane and a horizontal leg overlying the molding for the particular sheet of screen material with which it is associated, a stud extending upwardly through the top of the molding for each sheet of screen material, and a knob member threadedly attached to the upwardly extending stud member, said stud members providing points about which said perforate panels pivot when they are swung into said angles extending toward or away from the fireplace.

7. A fireplace screen unit in accordance with claim 6 in which each of said lower hinge members includes an angled member having a vertical leg attached to the molding for said glass pane and a horizontal leg extending beneath a portion of the molding for the sheet of screen material with which it is associated, and a rivet extending through the horizontal leg upwardly through a portion of the molding for the sheet of screen material.

8. A fireplace screen unit in accordance with claim 7 in which said molding portions through which said rivets extend are recessed upwardly.

* * * * *